US005321912A

United States Patent [19]

Neary et al.

[11] Patent Number: 5,321,912

[45] Date of Patent: Jun. 21, 1994

[54] MOVER REEL BLADE RELIEF GRINDING DEVICE

[75] Inventors: Timothy C. Neary, Plymouth; Roger L. Larson, Shoreview, both of Minn.

[73] Assignee: Neary Manufacturing, Inc., Elk River, Minn.

[21] Appl. No.: 989,691

[22] Filed: Dec. 14, 1992

[51] Int. Cl.[5] ..... B24B 3/42

[52] U.S. Cl. ..... 51/48 HE; 51/3; 51/95 LH

[58] Field of Search ..... 51/48 HE, 95 LH, 247, 51/3

[56] References Cited

U.S. PATENT DOCUMENTS

| | | | |
|---|---|---|---|
| 805,127 | 11/1905 | Fetters | 51/48 HE |
| 2,180,911 | 11/1939 | Rodgers | 51/48 HE |
| 2,279,798 | 4/1942 | Shelburne | 51/48 HE |
| 4,694,613 | 9/1987 | Bernhard | 51/48 HE |

*Primary Examiner*—Robert A. Rose

*Attorney, Agent, or Firm*—Peterson, Wicks, Nemer & Kamrath

[57] ABSTRACT

A relief grinding device (100) is disclosed including a flange assembly (106) slideably mounted on and rotatable with a grinding shaft (18) which is mounted on the free ends of pivot arms (14) pivotally mounted to a table (12). A grinding wheel (108) is mounted to and rotatable with the flange assembly (106). A back relief housing (114) is rotatably mounted to the flange assembly (106) and held at an adjustable angle on the grinding shaft (18) by a back relief restraint (124) adjustably secured thereto and slideable on a support shaft (102). A stop (134) for abutting with the first face of the blade is mounted to a holder (128) slideably mounted to a mount (122) of the back relief housing (114). A guide finger (138) for abutting with the opposite face of the blade is slideably mounted to the holder (128) and a holding block (136) secured to the stop (134). The blade freely passes between the stop (134) and the guide finger (138) which maintain the position and orientation of the blade relative to the grinding wheel (108) grinding a relief grind on the radially outer edge of the blade.

29 Claims, 3 Drawing Sheets

MOVER REEL BLADE RELIEF GRINDING DEVICE

BACKGROUND

The present invention generally relates to devices for relief grinding blades, particularly to devices for relief grinding blades of mower reels, and specifically to mower reel blade relief grinding devices utilized in a table-type sharpening system including a spin grinding device.

When manufactured, mower reels are ground to be perfect cylinders. The diameter at all points is equal. The bed knife is mounted so it is perfectly parallel to the blade surface across the full width of the mower. When the blades and knife are properly aligned the best cut is obtained.

Usually two things happen to cause a reel to lose its shape and become tapered. First, most cutting units require that field adjustments be made to keep reel and bedknife in the best cutting proximity. Excessive adjustment on one side causes the reel blades on that side to wear faster. Repetition of the overadjustment actually compounds the problem. The reel loses its cylindrical shape and becomes tapered. The second reason reels lose their cylindrical shape is traced to the very nature of the reels themselves. The natural helix (or twist) in the reel blades causes the "lead in" end of the reel to wear faster. The diameter at that end becomes smaller. Each time the mower reel is adjusted, the accelerated wear continues and the "lead in" diameter becomes even smaller.

If the simple "touch method" of alignment for sharpening is utilized where each end of the mower reel is contacted with the grinding wheel, the reel's conical or tapered condition is not corrected and the reel is not restored to a true cylinder. The difference between the two ends continues to increase, and eventually the taper exceeds the mower's range of adjustment.

To remove the conical shape and restore the reel back to a sharp cylindrical shape with all blade cutting edges ground to the same distance from the reel shaft, a grinding wheel is rotated and moved along an axis parallel to and spaced from the reel shaft while the reel is rotating on the reel shaft. One type of system utilized to spin grind a mower reel and which has been very commercially successful is of the table top variety. Specifically, the reel is mounted by suitable means above a table and with the reel shaft being parallel to and spaced from a grinding shaft. The grinding wheel is rotatable with but axially movable along the grinding shaft.

However, although table top grinding systems have been very successful in spin grinding, prior to the present invention they were unable to provide relief grinding of the blades of the mower reel. Relief grinding removes the excess steel behind the cutting edge (particularly on thick or heavy bladed reels) to allow the reel to operate with less wear and tear on its cutting surface and mow with less power consumption by the mower.

Thus, a need has arisen for a device for providing relief grinding of blades of a mower reel which can be utilized with a rotating grinding shaft and particularly which can be utilized in a table top grinding system.

SUMMARY

The present invention solves this need and other problems in the field of grinding mower reel blades or the like by providing, in the preferred form, a backstop for slideable abutment with a first face of a blade and a guide finger for slideable abutment with the opposite, second face of the blade movable with the grinding wheel along the rotation axis thereof with the blade slideably received between the backstop and the guide finger and extending at a tangent to the grinding wheel In a preferred aspect, the angle of the tangent and the radial spacing of the backstop and guide finger from the rotation axis of the grinding wheel are independently adjustable.

In the most preferred form, the sharpening system includes a grinding shaft, with the relief grinding device including the backstop and the grinding wheel thereof slideably mounted thereon and in the most preferred form with a spin grinding device including the grinding wheel thereof independently slideably mounted thereon.

It is thus an object of the present invention to provide a novel relief grinding device.

It is further an object of the present invention to provide such a novel relief grinding device which slideably receives the blade between a backstop and a guide finger.

It is further an object of the present invention to provide such a novel relief grinding device allowing adjustment for the blade thickness.

It is further an object of the present invention to provide such a novel relief grinding device allowing for adjustment of the relief angle being ground.

It is further an object of the present invention to provide such a novel relief grinding device allowing adjustment for wear of the grinding wheel.

It is further an object of the present invention to provide such a novel relief grinding device slideably mounted on a rotatable grinding shaft.

It is further an object of the present invention to provide such a novel relief grinding device provided in a sharpening system for mower reels.

It is further an object of the present invention to provide such a novel relief grinding device provided in a mower reel sharpening system including a spin grinding device.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
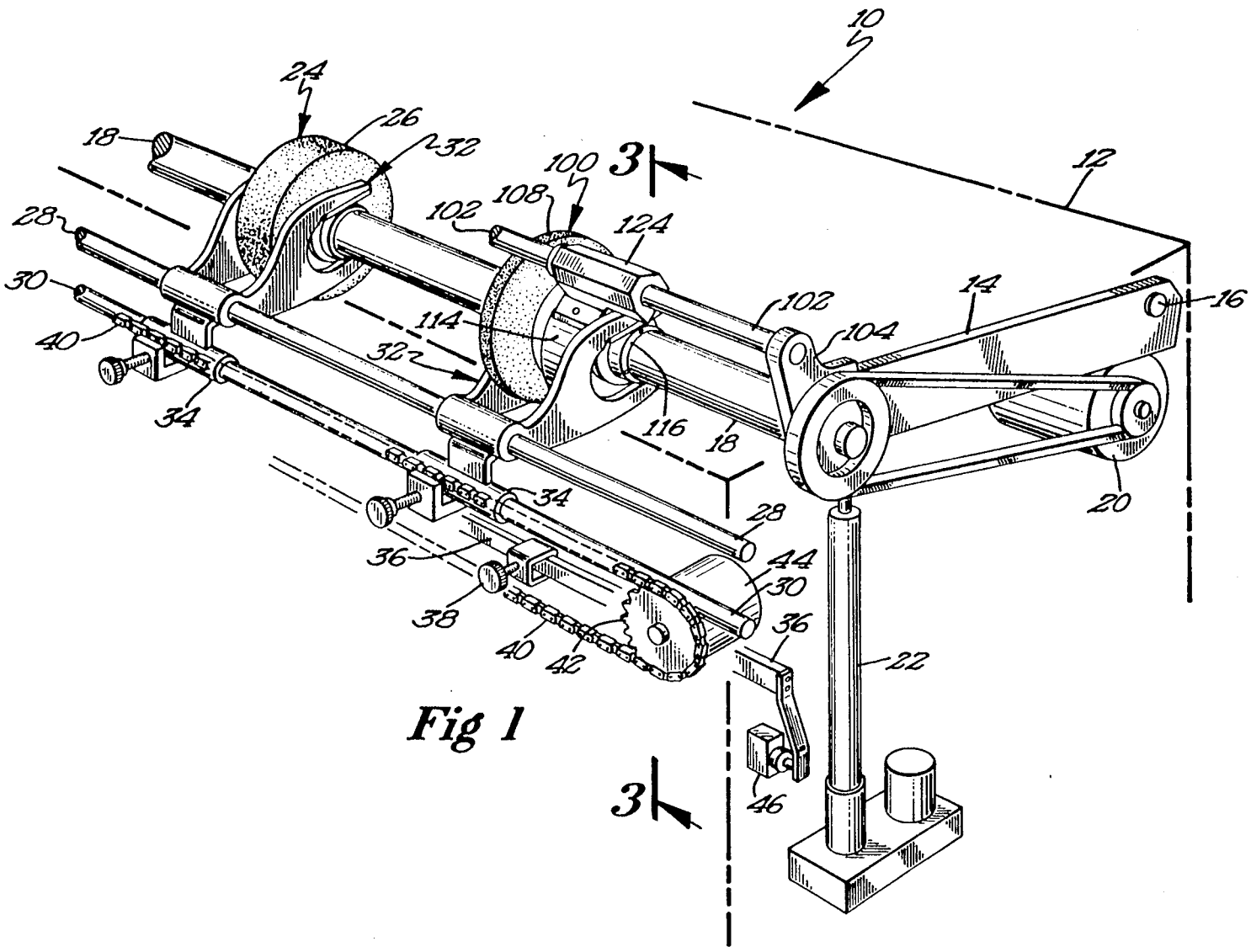
FIG. 1 shows a partial, rear perspective view of a mower reel sharpening system including a spin grinding device and a relief grinding device according to the preferred teachings of the present invention.
Figure 2:
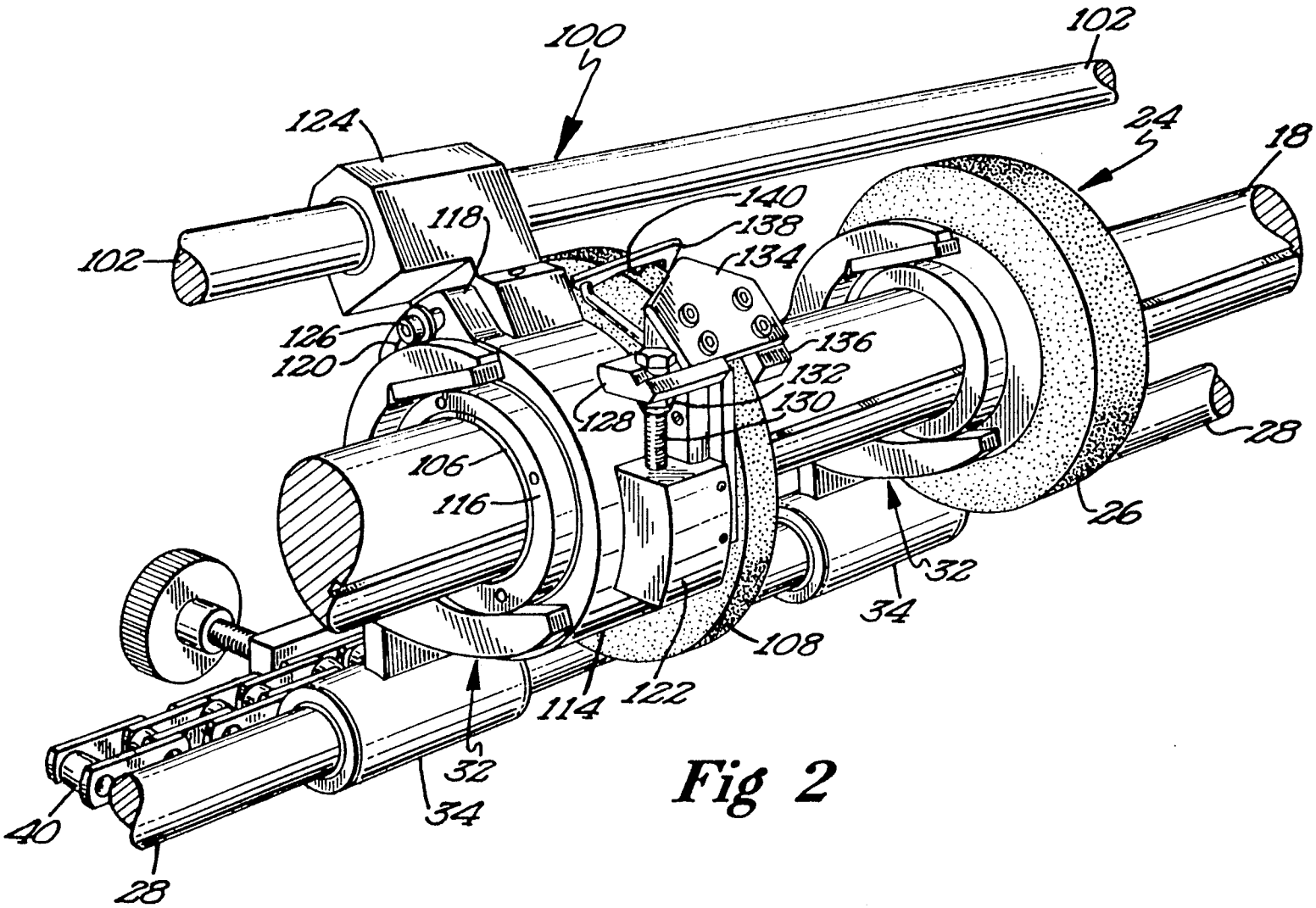
FIG. 2 shows a partial, front perspective view of the spin grinding device and the relief grinding device of FIG. 1.
Figure 3:
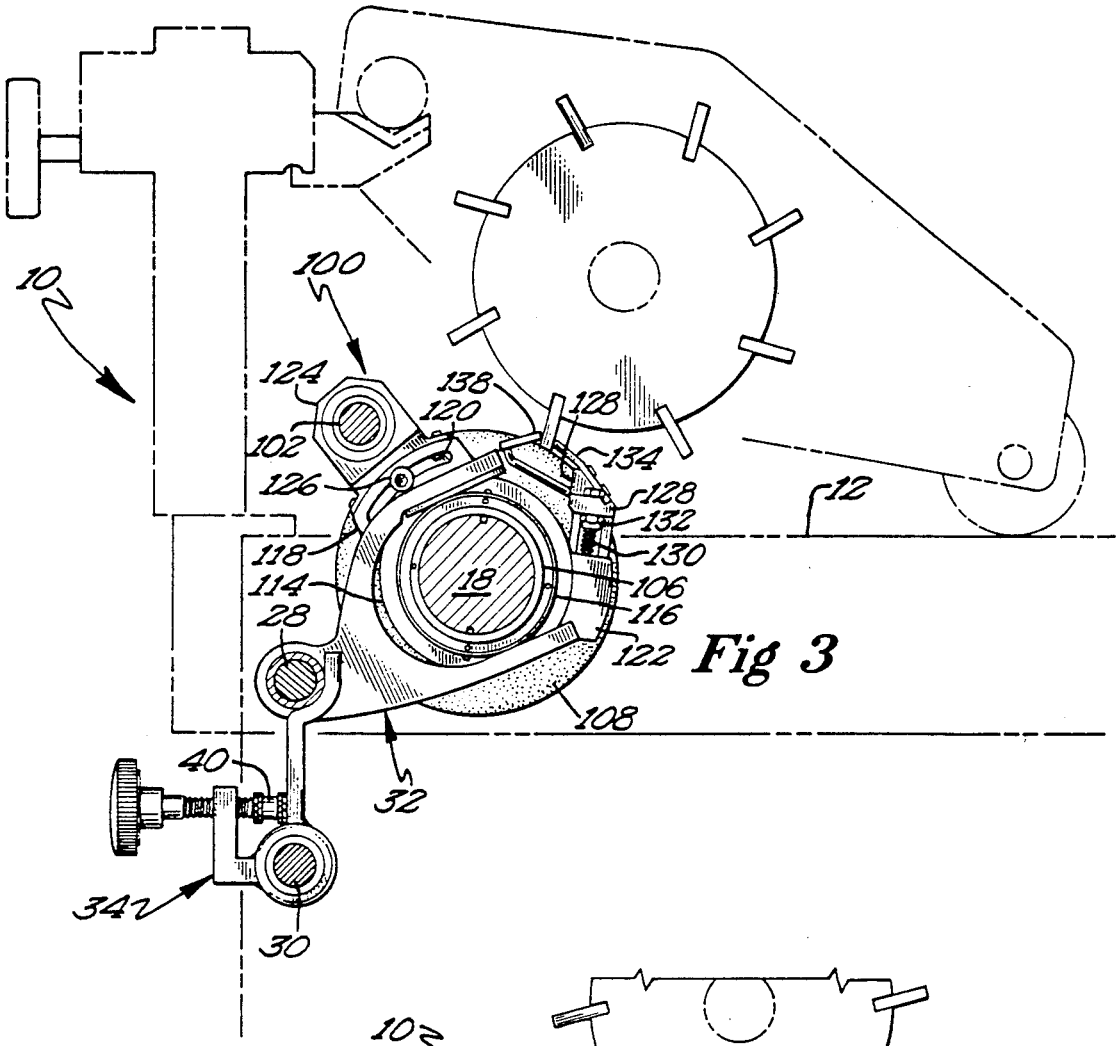
FIG. 3 shows a cross-sectional view of the relief grinding device of FIG. 1, with further portions of the mower reel and of the sharpening system being shown in phantom.
Figure 4:
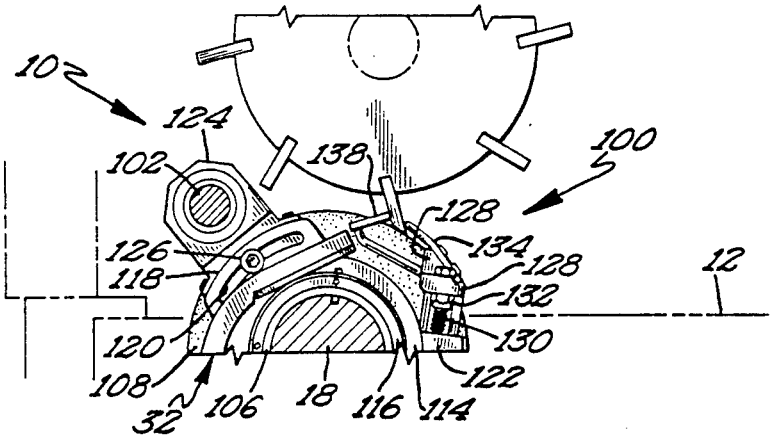
FIG. 4 shows a partial, cross-sectional view of the relief grinding device of FIG. 1, with further portions of the mower reel and of the sharpening system being shown in phantom.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts Furthermore, when the terms "top", "bottom", "first", "second", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

Device for relief grinding the blades of mower reels utilized in a sharpening system 10 providing spin sharpening according to the preferred teachings of the present invention is shown in the drawings and generally designated 100. System 10 in the most preferred form is of the type manufactured by Neary Manufacturing, Inc., Elk River, Minn., and generally includes a table 12. First and second pivot arms 14 are pivotally mounted by their back ends to table 12 about a pivot axis 16 extending along the back of table 12. A grinding shaft 18 is pivotally mounted and extends between the front ends of arms 14 generally parallel to axis 16. Shaft 18 can be rotated by any suitable means such as a motor 20. Arms 14 are pivoted relative to table 12 by any suitable means such as manual or electric actuators 22 extending between table 12 and arms 14, with actuators 22 being expandable and contractible to adjustably vary their total length.

System 10 further includes in the most preferred form a spin grinding device 24 for spin grinding the blades of mower reels. Particularly, device 24 includes a grinding wheel 26 which is slideably mounted upon shaft 18 but rotatably fixed thereto such as by a slideable keyway for rotation with shaft 18.

Device 24 further includes provisions for moving grinding wheel 26 axially on shaft 18 while shaft 18 and wheel 26 are rotating. In the most preferred form, first and second rods 28 and 30 are mounted to table 12. A fork assembly 32 is slideable and rotatable on rod 28 and include first and second U-shaped tines located on opposite sides of grinding wheel 26, with the legs of the tines located on opposite sides of grinding shaft 18. It can then be appreciated that fork assembly 32 will pivot on rod 28 as grinding shaft 18 is moved relative to table 12 by pivoting arms 14. A transverse control assembly 34 is slideable and rotatable on rod 30 and includes an arm for releasable engagement with fork assembly 32. A switch bar 36 is slideably mounted in table 12. First and second stop brackets 38 are slideably, adjustably secured to bar 36 for positioning thereon equal to the ends of the mower reel. Control assembly 34 when engaged with fork assembly 32 will abut and travel between brackets 38. A roller drive chain 40 extends between first and second sprockets 42, one of which is driven by suitable means such as an electric motor 44. Control assembly 34 is secured to roller drive chain 40 at a point between sprockets 42. Thus, with sprockets 42 rotating in a first direction, drive chain 40 will travel in a first linear direction. As control assembly 34 is secured to drive chain 40, control assembly 34 also slides on rod 30 in the first direction which in turn also slides finger assembly 32 on rod 28 which in turn also slides grinding wheel 26 on shaft 18. However, when control assembly 34 engages the first stop bracket 38, switch bar 36 is also pushed and slid in table 12 to actuate a limit switch 46 which changes the rotation direction of motor 44. Thus, sprockets 42 will rotate in the opposite direction, with drive chain 40, control assembly 34, finger assembly 32, and grinding wheel 26 also sliding in the opposite direction. When control assembly 34 engages the second stop bracket 38, switch bar 36 is also pushed and slid in table 12 in the opposite direction to actuate limit switch 46 which changes the rotation direction of motor 44 back to the first direction.

In operation of spin grinding device 24, the mower reel is held in a position with the reel shaft at a constant distance from table 12 and parallel to grinding shaft 18. The mower reel is rotated with the blades of the mower reel rotating about an axis defined by the reel shaft by a suitable spin drive in the same rotation direction as grinding wheel 26 rotates about the wheel axis. Arms 14 are pivoted relative to table 12 such that grinding wheel 26 engages the radially outer edges of the blades of the mower reels to place a spin grind surface thereon as they rotate past grinding wheel 26. Simultaneously, grinding wheel 26 is moved back and forth along the length of the blades utilizing motor 44. When spin grinding the radially outer edge, the spin grind surface is ground slightly in front of the highest point on grinding wheel 26 or in other words in the direction opposite to the direction of rotation of grinding wheel 26 of a line extending between the axes of rotation of grinding wheel 26 and the mower reel, with the spin grind surface on the radially outer edge extending generally tangentially from grinding wheel 26. The spacing between the axes of rotation of grinding wheel 26 and the mower reel is generally equal to the combined distance of the radius of grinding wheel 26 and of the radius of the mower reel.

System 100 generally includes a support shaft 102 extending parallel to and spaced from grinding shaft 18. In the most preferred form, shaft 102 is supported by first and second bearing housings 104 secured to the front ends of first and second pivot arms 14, respectively.

System 100 further includes a wheel flange assembly 106 which is slideably received on and rotatable with grinding shaft 18 such as by a slideable keyway. A grinding wheel 108 is slideably received on and rotatable with flange assembly 106, with grinding wheel 108 being sandwiched between a radially extending annular flange extending from flange assembly 106 and a flange nut threadably received on flange assembly 106. A back relief housing 114 is rotatably mounted on flange assembly 106 by suitable bearings, with housing 114 sandwiched between the radially extending annular flange of flange assembly 106 and a bearing retention ring 116 threadably received on flange assembly 106. Housing 114 includes an integral, radially extending ear 118 having an arcuate slot 120 extending approximately 50° around grinding shaft 18. Housing 114 further includes an integral slide mount 122 located approximately 135° from ear 118.

A back relief restraint 124 is slideably mounted on support shaft 102 by suitable slide bearings. Housing 114 is adjustably secured to restraint 124 by bolt 126 extending through slot 120 of ear 118 and threadably received in restraint 124. It can then be appreciated that the securement of housing 114 to restraint 124 prevents rotation of housing 114 with grinding shaft 18, flange assembly 106, and grinding wheel 108. Additionally, due to the adjustable securement provided by bolt 126 extending through slot 120, housing 114 can be pivoted at different angles about grinding shaft 18 within the circumferential extent of slot 120.

System 100 further includes a holder 128 slideably mounted to mount 122 such as by a dovetail-type slide between holder 128 and mount 122. Holder 128 is adjustably positioned relative to mount 122 by a bolt 130 passing through holder 128 and threadably received in mount 122. Holder 128 is sandwiched between the head of bolt 130 and a lock 132 secured to bolt 130 on the opposite side of holder 128 than the head of bolt 130. Thus, when bolt 130 is threaded into or out of mount 122, the head of bolt 130 and lock 132 which sandwiches holder 128 move toward and away from mount 122 thus causing holder 128 to slide relative to mount 122.

A back relief stop 134 is mounted to holder 128 and includes a point for abutting with the first face of the blades of the mower reel. A holding block 136 is secured to stop 134 on the opposite side of grinding wheel 108 than holder 128.

System 100 further includes a guide finger 138 including a point for abutting with the second, opposite face of the blades of the mower reel. In the most preferred form, finger 138 includes a recess 140 for straddling grinding wheel 108. Finger 138 is adjustably mounted to holder 128 and block 136 in the most preferred form by first and second, parallel, spaced pins slideably received in holder 128 and block 136, respectively. It can then be appreciated that stop 134 and finger 138 are adjustably mounted to housing 114 in the most preferred form by slideably mounting stop 134 to housing 114 and by slideably mounting finger 138 to stop 134.

In the most preferred form, system 100 includes provisions for moving flange assembly 106, grinding wheel 108, and housing 114 axially on shaft 18 while shaft 18, flange assembly 106, and grinding wheel 108 are rotating. In the most preferred form, flange assembly 106, grinding wheel 108, and housing 114 are slid by the same means as for moving grinding wheel 26 and specifically, a separate fork assembly 32 and control assembly 34 are provided, with drive chain 40 being releasably secured to control assemblies 34 when the associated grinding wheel 26 or 108 is not being utilized.

In operation of relief grinding device 100, the point of stop 134 is placed to abut with the first face of one of the blades of the mower reel and the point of finger 138 is placed to abut with the second, opposite face of the blade. When relief grinding the radially outer edge, the radially outer edge of the blade is ground behind the highest point on grinding wheel 108 or in other words in the rotation direction of grinding wheel 108 beyond a line extending between the axes of rotation of grinding wheel 108 and the mower reel, with the relief grind surface on the radially outer edge extending tangentially from grinding wheel 108. The spacing between the axes of rotation of grinding wheel 108 and the mower reel is less than the combined distance of the radius of grinding wheel 108 and of the radius of the mower reel. Thus, the mower reel is not able to rotate 360° about the reel shaft when relief grinding device 100 is utilized. However, it should be realized that due to the natural helix (or twist) of the reel blades, the control of blade maintained by stop 134 and finger 138 causes the mower reel to pivot about the reel shaft so that the reel blades remain in the proper grinding orientation to grinding wheel 108.

It should then be appreciated that various adjustments are allowed in relief grinding device 100 according to the preferred teachings of the present invention. First, finger 138 can be adjusted relative to stop 134 by sliding in the most preferred form to accommodate the thickness of the blades of a particular mower reel. Second, stop 134 (and finger 138 slideably mounted thereto) can be adjusted relative to mount 122 to adjust the radial spacing from shaft 18 by sliding holder 128 relative to mount 122 by rotation of bolt 130 to compensate for grinding wheel wear and to give the proper distance for the individual blade of the mower reel to track stop 134 during relief grinding. The relief angle, or in other words the angle of the tangent of the front and back surfaces of the blade to grinding wheel 108, can be adjusted by moving the position of the blade relative to grinding wheel 108. The position of the blade relative to grinding wheel 108 is then dependent on the location of the mower reel on table 12, the position of arms 14 and thus grinding shaft 18 and grinding wheel 108 relative to table 12 and the mower reel clamped thereto, and the angle of back relief housing 114 and stop 134 and finger 138 mounted thereon on grinding shaft 18. Adjustment of the angle of back relief housing 114 and stop 134 and finger 138 mounted thereon on grinding shaft 18 can be made by loosening bolt 126 allowing manual rotation of back relief housing 114 on grinding shaft 18 and relative to back relief restraint 124. Relief angles can vary from as little as 10° to 15° to as much as 45° depending upon the original manufacturer's specifications for the particular mower reel being ground.

It should further be appreciated that although relief grinding device 100 has been explained according to the preferred teachings of the present invention for use in grinding blades of a mower reel in sharpening system 10 including grinding shaft 18 pivotable relative to table 12, relief grinding device 100 may have application in grinding blades of other types and in other types of sharpening systems.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for relief grinding a blade having a radially outer edge of an elongated length and first and second faces, with the spacing between the first and second faces defining a thickness, with the first and second faces extending generally radially from a center axis, comprising, in combination: a grinding wheel rotatable about and axially movable along a wheel axis, with the wheel axis being parallel to and spaced from the center axis; a backstop for slideable abutment with the first face of the blade; a guide finger for slideable abutment with the second face of the blade; means for movably mounting the backstop and the guide finger for movement with the grinding wheel along the wheel axis with the backstop and guide finger slideably receiving the blade therebetween with the grinding wheel grinding a relief grind surface on the radially outer edge of the blade extending at a tangent to the grinding wheel; and a spin grinding wheel rotatable about and independently axially movable along the wheel axis for spin grinding the radially outer edge of the blade.

2. The relief grinding device of claim 1 further comprising, in combination: a grinding shaft defining the wheel axis and having a length at least equal to the elongated length of the radially outer edge of the blade, with the grinding wheel and the spin grinding wheel being rotatable with and slideable on the grinding shaft.

3. Device for relief grinding a blade having a radially outer edge of an elongated length and first and second faces, with the spacing between the first and second faces defining a thickness, with the first and second faces extending generally radially from a center axis, comprising, in combination: a grinding shaft having a length at least equal to the elongated length of the radially outer edge of the blade and being parallel to and spaced from the center axis; a grinding wheel rotatable with and slideable on the grinding shaft; an annular housing rotatable about and slideably received on the grinding shaft; a backstop for slideable abutment with the first face of the blade; a guide finger for slideable abutment with the second face of the blade, with the backstop and the guide finger mounted to the housing and slideably receiving the blade therebetween with the grinding wheel grinding a relief grind surface on the radially outer edge of the blade extending at a tangent to the grinding wheel; and means for preventing rotation of the housing with the grinding shaft and the grinding wheel.

4. The relief grinding device of claim 3 wherein the rotation preventing means comprises, in combination: a support shaft extending parallel to and spaced from the grinding shaft; and a restraint secured to the housing for slideable abutment with the support shaft.

5. The relief grinding device of claim 4 further comprising, in combination: means for adjustably securing the restraint to the housing for holding the housing and the backstop and the guide finger mounted thereto at different pivot angles about the grinding shaft for adjusting the angle of the tangent that the relief grind surface extends from the grinding wheel.

6. The relief grinding device of claim 5 further comprising, in combination: means for adjustably mounting the backstop and the guide finger to the housing.

7. The relief grinding device of claim 6 wherein the adjustably mounting means comprises means for slideably mounting the backstop to the housing.

8. The relief grinding device of claim 7 wherein the adjustably mounting means further comprises, in combination: means for mounting the guide finger to the backstop.

9. The relief grinding device of claim 8 wherein the guide finger mounting means comprises means for slideably mounting the guide finger to the backstop.

10. The relief grinding device of claim 3 further comprising, in combination: a spin grinding wheel rotatable with and independently slideable on the grinding shaft for spin grinding the radially outer edge of the blade.

11. The relief grinding device of claim 1 wherein the movably mounting means comprises, in combination: an annular housing rotatable about and movable axially along the wheel axis with the grinding wheel, with the backstop and the guide finger mounted to the housing.

12. The relief grinding device of claim 11 further comprising, in combination: means for pivoting the housing about to the wheel axis for adjusting the angle of the tangent that the relief grind surface extends from the grinding wheel.

13. The relief grinding device of claim 12 further comprising, in combination: means for adjustably mounting the backstop and the guide finger to the housing.

14. The relief grinding device of claim 13 wherein the adjustably mounting means comprises means for slideably mounting the backstop to the housing.

15. The relief grinding device of claim 14 wherein the adjustably mounting means further comprises, in combination: means for mounting the guide finger to the backstop.

16. Device for relief grinding a blade having a radially outer edge of an elongated length and first and second faces, with the spacing between the first and second faces defining a thickness, with the first and second faces extending generally radially from a center axis, comprising, in combination: a grinding wheel rotatable about and axially movable along a wheel axis, with the wheel axis being parallel to and spaced from the center axis; a backstop for slideable abutment with the first face of the blade; a guide finger for slideable abutment with the second face of the blade; a housing movable axially along the wheel axis with the grinding wheel; and means for adjustably mounting the backstop and the guide finger to the housing with the backstop and guide finger slideably receiving the blade therebetween with the grinding wheel grinding a relief grind surface on the radially outer edge of the blade extending at a tangent to the grinding wheel.

17. The relief grinding device of claim 1 wherein the movably mounting means includes means for adjusting the angle of the tangent that the relief grind surface extends from the grinding wheel.

18. The relief grinding device of claim 17 wherein the movably mounting means includes means for adjusting the radial spacing of the backstop and guide finger from the wheel axis.

19. The relief grinding device of claim 1 wherein the movably mounting means includes means for adjusting the radial spacing of the backstop and guide finger from the wheel axis.

20. The relief grinding device of claim 19 wherein the adjusting means comprises, in combination: means for adjusting the radial spacing of the backstop from the wheel axis; and means for slideably mounting the guide finger to the backstop.

21. Device for relief grinding a blade having a radially outer edge of an elongated length and first and second faces, with the spacing between the first and second faces defining a thickness, with the first and second faces extending generally radially from a center axis, comprising, in combination: a grinding shaft defining a wheel axis and having a length at least equal to the elongated length of the radially outer edge of the blade; a grinding wheel rotatable with and axially slideable on the grinding shaft, with the wheel axis being parallel to and spaced from the center axis; a backstop for slideable abutment with the first face of the blade; means for movably mounting the backstop for movement with the grinding wheel along the grinding shaft with the backstop slideably abutting the first face of the blade with the grinding wheel grinding a relief grind surface on the radially outer edge of the blade extending at a tangent to the grinding wheel; and a spin grinding wheel rotatable with and independently slideable on the grinding shaft for spin grinding the radially outer edge of the blade.

22. Device for relief grinding a blade having a radially outer edge of an elongated length and first and second faces, with the spacing between the first and second faces defining a thickness, with the first and second face extending generally radially from a center axis, comprising, in combination: a grinding shaft defining a wheel axis and having a length at least equal to the elongated length of the radially outer edge of the blade; a grinding wheel rotatable with and axially slideable on the grinding shaft, with the wheel axis being parallel to and spaced from the center axis; a backstop for slideable abutment with the first face of the blade; and an annular housing rotatable upon and slideably received in the grinding shaft, with the backstop mounted to the housing with the backstop slideably abutting the first face of the blade with the grinding wheel grinding a relief grind surface on the radially outer edge of the blade extending at a tangent to the grinding wheel; and means for preventing rotation of the housing with the grinding shaft and the grinding wheel.

23. The relief grinding device of claim 3 further comprising, in combination: means for adjustably mounting the backstop and the guide finger to the housing.

24. The relief grinding device of claim 4 further comprising, in combination: means for moving the grinding wheel on the grinding shaft comprising, in combination: a rod extending parallel to and spaced from the grinding shaft and the support shaft; and a fork assembly slideable on the rod and engaging the grinding wheel.

25. Device for relief grinding a blade having a radially outer edge of an elongated length and first and second faces, with the spacing between the first and second faces defining a thickness, with the first and second faces extending generally radially from a center axis, comprising, in combination: a grinding wheel rotatable about and axially movable along a wheel axis, with the wheel axis being parallel to and spaced from the center axis; a backstop for slideable abutment with the first face of the blade; a guide finger for slideable abutment with the second face of the blade; means for movably mounting the backstop for movement with the grinding wheel along the wheel axis; and means for slideably mounting the guide finger to the backstop, with the backstop and guide finger slideably receiving the blade therebetween with the grinding wheel grinding a relief grind surface on the radially outer edge of the blade extending at a tangent to the grinding wheel.

26. The relief grinding device of claim 25 wherein the movably mounting means includes means for adjusting the radial spacing of the backstop from the wheel axis.

27. The relief grinding device of claim 16 wherein the adjustably mounting means comprises means for slideably mounting the backstop to the housing.

28. The relief grinding device of claim 27 wherein the adjustably mounting means further comprises, in combination: means for mounting the guide finger to the backstop.

29. The relief grinding device of claim 28 wherein the guide finger mounting means comprises means for slideably mounting the guide finger to the backstop.

* * * * *

UNITED STATES PATENT AND TRADEMARK OFFICE

CERTIFICATE OF CORRECTION

PATENT NO. : 5,321,912
DATED : June 21, 1994
INVENTOR(S) : Neary, et. al.

It is certified that error appears in the above-indentified patent and that said Letters Patent is hereby corrected as shown below:

Title page, item [54] and col. 1, line 1, cancer "MOVER" and substitute therefor --MOWER--.
Title page, item [56], under References Cited and after the list of U.S. Pat. Doc, insert--

--OTHER DOCUMENTS

*Neary Reel Mower Grinder, Model #100, Neary Manufacturing, Elk River, Minnesota*

*Neary Manufacturing, Inc. Model 170 Mower Machining Center, Neary Manufacturing, Elk River, Minnesota*

*Neary Spin-Matic Reel Mower Grinder Model 500, Neary Manufacturing, Elk River, Minnesota*--

Column 1, line 2, cancel "MOVER" and substitute therefor --MOWER--.

Column 2, line 6, after "wheel" insert --.--.

Column 9, line 16, cancel "face" and substitute therefor --faces--.

UNITED STATES PATENT AND TRADEMARK OFFICE

CERTIFICATE OF CORRECTION

PATENT NO. : 5,321,912
DATED : June 21, 1994
INVENTOR(S) : Neary, et. al.

It is certified that error appears in the above-indentified patent and that said Letters Patent is hereby corrected as shown below:

Column 9, line 24, cancel "in" and substitute therefor --on--.

Signed and Sealed this

Thirtieth Day of August, 1994

*Attest:*

*Attesting Officer*

BRUCE LEHMAN

*Commissioner of Patents and Trademarks*